US005542555A

United States Patent [19]

Hidding et al.

[11] Patent Number: 5,542,555

[45] **Date of Patent: * Aug. 6, 1996**

[54] VALVED BOTTLE CAP

[76] Inventors: Walter E. Hidding, 367A Woodrock Rd.; Douglas J. Hidding, 801 E. Lake Shore Dr., both of Barrington, Ill. 60010; Robert D. Hidding, 925 Harper Dr., Algonquin, Ill. 60102

[ * ] Notice: The term of this patent shall not extend beyond the expiration date of Pat. No. 5,392,939.

[21] Appl. No.: 325,005

[22] Filed: Dec. 27, 1994

Related U.S. Application Data

[63] Continuation of Ser. No. 955,004, Oct. 1, 1992, Pat. No. 5,392,939.

[51] Int. Cl.[6] ..... B65D 51/18

[52] U.S. Cl. ..... 215/265; 215/227; 215/303; 141/363; 141/348; 141/351

[58] Field of Search ..... 141/363, 375, 141/346, 347, 348, 349, 350, 351, 352, 353, 354, 355, 356, 357; 215/227, 264, 265, 267, 303

[56] References Cited

U.S. PATENT DOCUMENTS 2,904,204 9/1959 Naphtal et al. ..... 215/320

4,874,023 10/1989 Ulm ..... 141/346

5,121,778 6/1992 Baker et al. ..... 141/363 X

*Primary Examiner*—Allan N. Shoap

*Assistant Examiner*—Nathan Newhouse

*Attorney, Agent, or Firm*—Baker & McKenzie

[57] ABSTRACT

A cap for use with bottled water dispensing systems. The cap includes a main outer cap and an inner cap. The main outer cap has a central sleeve which receives and seals against a probe. The inner cap moves into and out of a sealing engagement with the central tube as the bottle is raised and lowered over the probe. The seal between the inner cap and the central tube is located on the outside surface of the central tube. The inner cap has a guide sleeve which centers the inner cap about the central tube, which is particularly important to achieve a proper attachment of the inner cap to the central tube during removal of the bottle from its support. The locations of the various components of the cap allow the cap to have effective differentials between the forces which are necessary to achieve proper sequencing of the formation of the various seals and connections which occur during use of the cap.

5 Claims, 3 Drawing Sheets

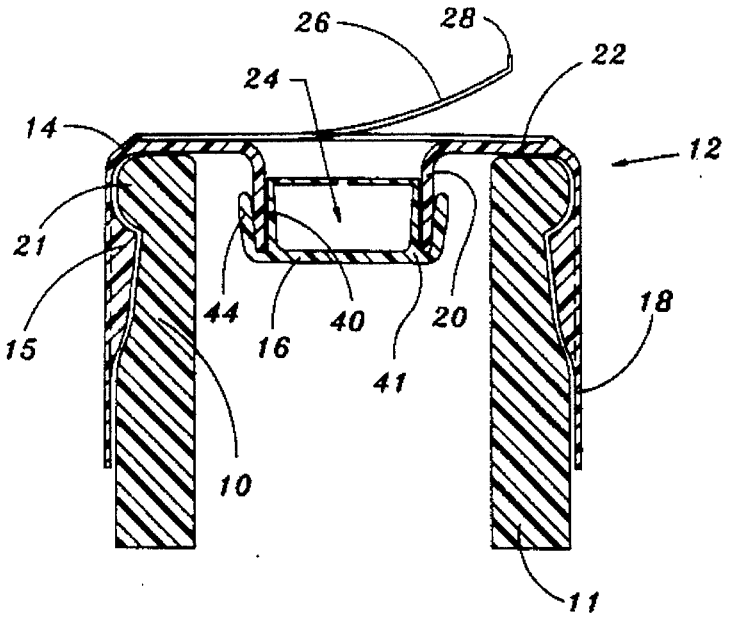
Fig. 1
Fig. 2
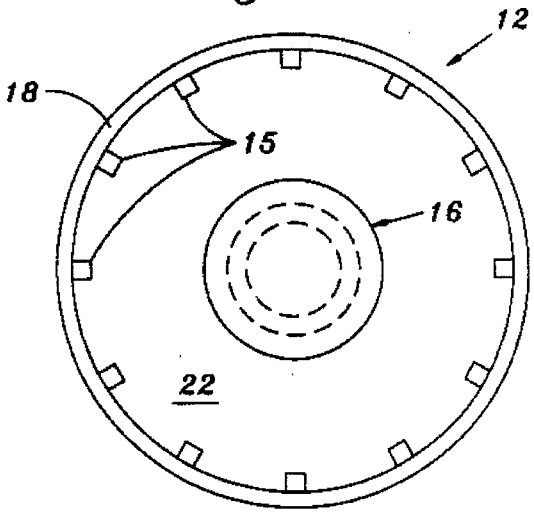
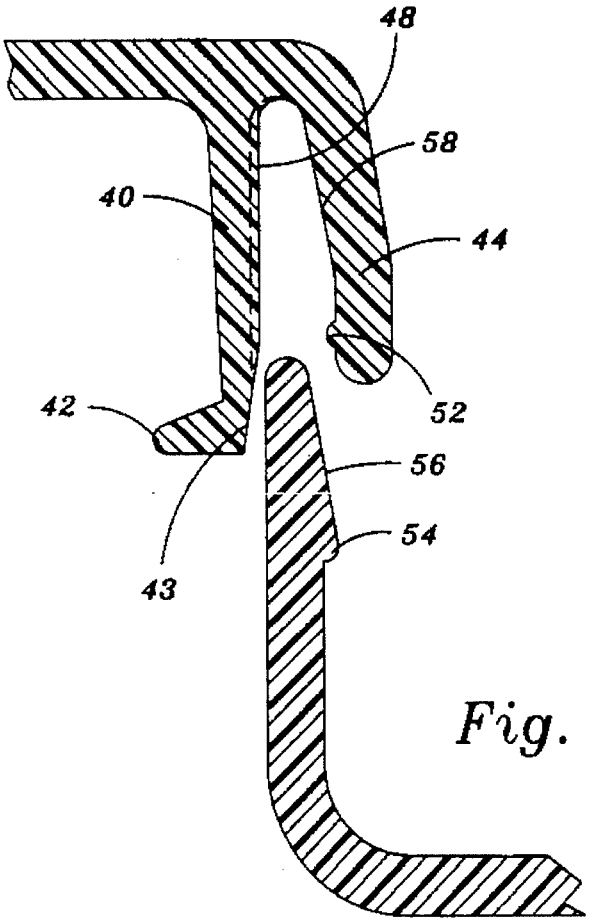
Fig. 3

Fig. 7
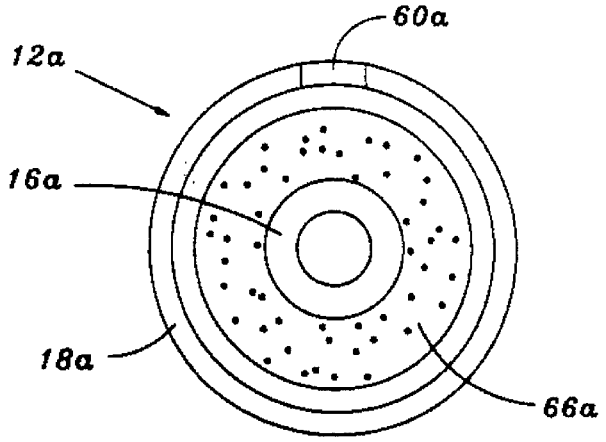
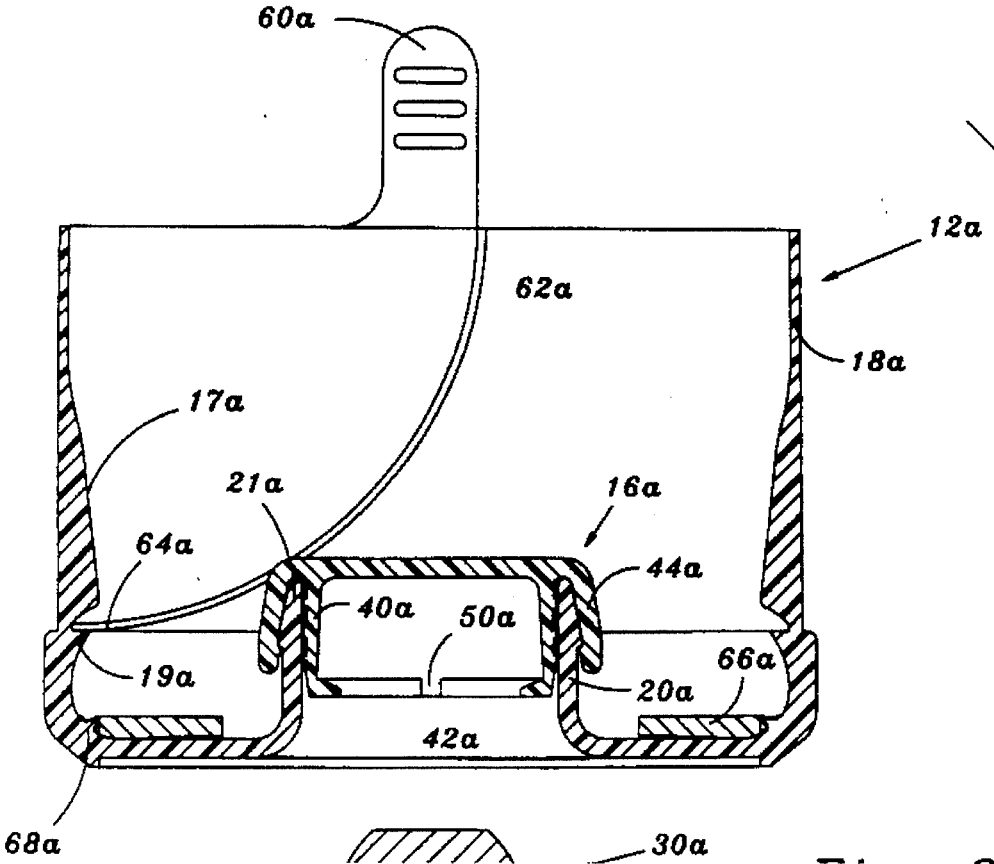
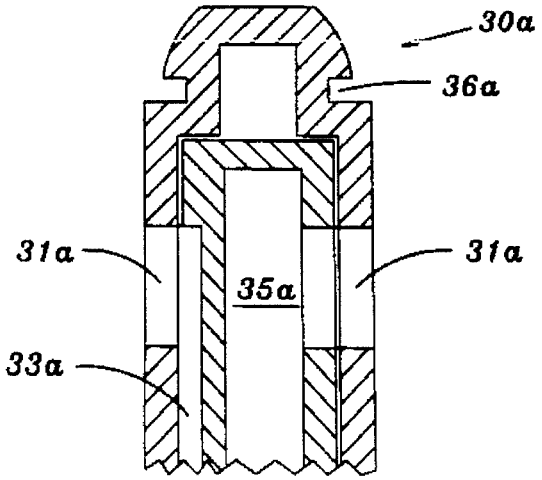
Fig. 8

VALVED BOTTLE CAP

This is a continuation of application Ser. No. 07/955,004, filed Oct. 1, 1992, now U.S. Pat. No. 5,392,959.

BACKGROUND AND SUMMARY OF THE INVENTION

The present invention relates generally to bottle caps which form closures on containers which are used in liquid dispensing systems.

Water coolers which use bottled water, such as the system shown in U.S. Pat. No. 5,121,778 (the "'778 patent"), are generally equipped with reservoirs. The reservoirs are kept filled with water supplied by an inverted large capacity water bottle. The capacity of such water bottles is generally five to six gallons.

In recent years, water cooler manufacturers have addressed problems with traditional water cooler systems. Those problems include the difficulty of inverting an open water bottle, and concerns relating to the growth of bacteria in the reservoirs resulting from exposure of the reservoir to the atmosphere. Examples of attempts to solve these problems are shown in the '778 patent, as well as in U.S. Pat. No. 4,699,188 (the "'188 patent"). In the '188 patent, a probe capable of piercing a cap on the water bottle is rigidly connected to the base of the support for the water bottle. The bottle cap includes a central tube with a pierceable membrane at one end of the tube. The tube is integrally formed with the bottle cap. Earlier attempts to solve problems associated with inverting a filled water bottle are shown in U.S. Pat. Nos. 4,846,236 and 4,597,423.

The system shown in the '778 patent includes a blunt probe which displaces a frangible plug integrally formed at one end of a central tube in the water bottle cap. The blunt probe of the '778 patent is equipped with means for pulling the frangible plug back into engagement with the central tube in the event that the bottle is lifted from the probe. This provides clear advantages as compared to systems in which a water bottle cap is completely removed prior to being inverted and placed on a water cooler. First, the problem of spilling water, when the bottle is initially installed, is solved, since the frangible connection remains intact and the cap remains sealed until a seal between the probe and the central tube has been achieved. Second, the plug seals the central tube automatically upon removal of the bottle from the cooler, even if the bottle is not empty. This eliminates spillage if it becomes necessary to remove the bottle from the cooler before the bottle is empty. Such removal may be necessary, for example, if repair or relocation of the cooler is required.

Finally, the resealing of the cap by the plug upon removal of an empty bottle provides protection against contamination of the empty bottle on its return trip to a water bottling facility. The inability to remove and replace the plug without the use of a probe provides the cap with a form of tamper evidence upon which bottlers can rely when deciding what kind of cleaning process to use in preparing a bottle for refilling.

However, the cap shown in the '778 patent has at least two inherent problems. First, there is a tendency for the edges of the central tube of the '778 cap to pry the plug away from its engagement with the blunt probe. When this happens, the plug does not engage the central tube and the water bottle is not sealed. This absence of a seal will result in spillage if the bottle is removed before it is empty, and in the loss of contamination protection for its return trip to the water bottling facility.

Another problem associated with the cap shown in the '778 patent is the difficulty of molding or constructing the cap as it is shown in the '778 patent. The cap has a combination of undercuts which make it impossible to mold the cap in one entire piece. Unless the cap is assembled from two pieces, such as those shown in FIG. 8 of the '778 patent, a situation known as "trapped steel" will occur, which prevents the cap from being removed from a mold without destroying the cap. The presence of the multiple undercuts and the criticality of molding the frangible connection between the plug and the central tube in the cap requires that the cap of the '778 patent be initially formed of two components. Those components must subsequently be welded or otherwise bonded together to form a single unitary cap. The welding or bonding operation is somewhat problematic in that the connection between the two components must not only be structurally sound, but must form a seal. In addition, the heat generated by a sonic-welding operation may detrimentally affect the frangible connection by lowering the breaking point of that connection. Maintaining a predictable and consistent breaking point for the frangible connection is required to ensure that the blunt probe fully engages the plug prior to breaking of the frangible connection.

A further problem associated with manufacture of the cap shown in the '778 patent relates to the handling of the component which contains the frangible connection. In order to weld the two components which comprise the cap, the portion containing the central tube and the plug frangibly connected thereto must be fed or otherwise conveyed to a position in which it can be welded to the remaining part of the cap. Handling operations must be done carefully so as not to prematurely break or weaken the frangible connection. If the frangible connection is weakened or otherwise improperly formed, the plug may have a tendency to leak or prematurely break free from the central tube of the cap before a secure connection between the plug and the probe has been achieved. When this occurs, the plug will come floating to the surface of the water in the bottle. This is a highly undesirable condition referred to as creating a "floater". The surface of the water is a highly visible location in most cooler/bottle arrangements, and users of the system do not like to see pieces of plastic floating in the water they are about to drink. Creating a "floater" also has the earlier discussed disadvantages of spillage upon early removal of the bottle, and the lack of a seal for the bottle's return trip to the bottling facility.

The above described problems and disadvantages are overcome by a cap for bottles used in water cooler systems which includes a main outer cap and an inner cap. The inner cap forms a seal on the outside surface of a central tube carried by the outer cap. Further, by causing the inner cap to seal against the outside surface of the central tube, the tendency for the inner cap to prematurely disengage from the probe is greatly reduced.

A cap of the present invention is comprised of two parts. The first part is an outer, or main, cap body, and is comprised of a generally cylindrical skirt and a central tube joined to and integrally formed with the skirt by an annular base. The central tube is equipped with external retaining means in the form of a circumferential bead formed on the outer surface of the central tube. The second part of the cap is an inner cap which is comprised of two generally cylindrical concentric sleeves, a guide sleeve and a sealing sleeve, joined by an inner cap base. The guide sleeve is smaller in diameter but longer in axial length than the sealing sleeve. The sealing sleeve has retaining means in the form of a circumferential bead formed on its inside surface. The bead on the sealing sleeve cooperates with the external bead on the central tube of the first component of the cap. The guide sleeve has a tapered free end which facilitates insertion of the guide sleeve into the central tube. The guide sleeve ensures proper concentric alignment of the sealing sleeve with respect to the central tube, thus enhancing the reliability associated with resealing of the central tube when the bottle is removed from the cooler. Splines or axial channels are formed on the outside surface of the guide sleeve to prevent buildup of pressure in the space between the two sleeves as the cap is placed into engagement with the central tube. The inside edge of the free end of the guide sleeve is equipped with means for engaging and being retained by a blunt probe having a retaining groove formed thereon. The annular base of the main cap is provided with a recess into which is placed a removable protective label which prevents the inside of the guide sleeve and the inside of the central tube from becoming dirty during shipment of bottles equipped with caps of the present invention.

These and other features and advantages of the invention will be better understood upon a reading of the following detailed description of the invention read in conjunction with the accompanying drawings, wherein:

BRIEF DESCRIPTION OF THE DRAWINGS

FIG. 1 is a sectional view showing a cap of the present invention installed on a container neck;

FIG. 2 is a bottom plan view of the cap shown in FIG. 1;

FIG. 3 is an enlarged sectional view showing a portion of the inner cap of the present invention just prior to or after its engagement with the central tube.

FIG. 7 is a bottom plan view of an alternative embodiment of the cap of the present invention; and FIG. 8 is a sectional view of cap shown in FIG. 7, together with a sectional view of the probe.

DETAILED DESCRIPTION OF THE INVENTION

Figure 6:
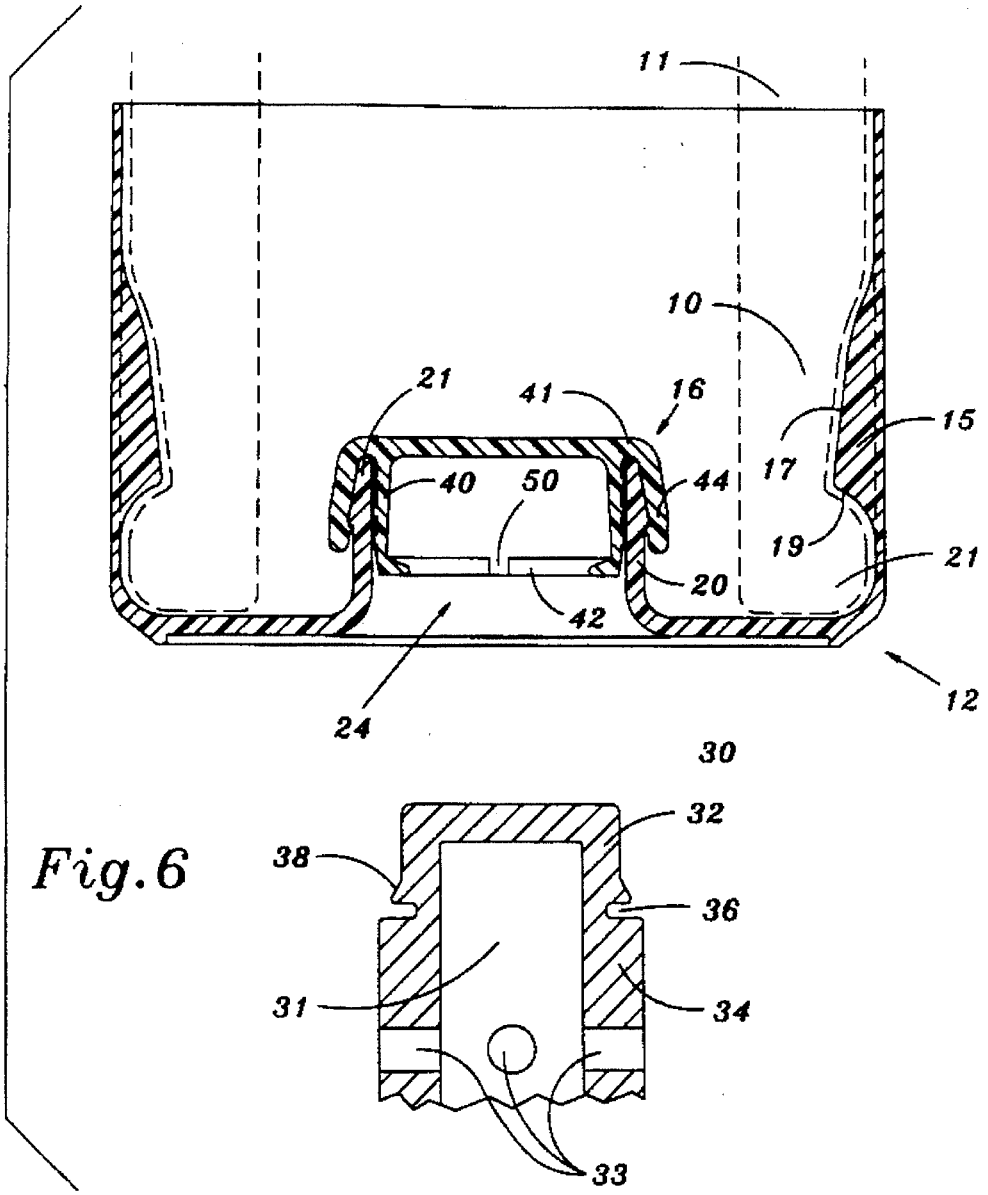
FIG. 6 is an enlarged sectional view showing the cap of the present invention, together with a probe, just prior to or after the cap's engagement with a probe.
Figure 5:
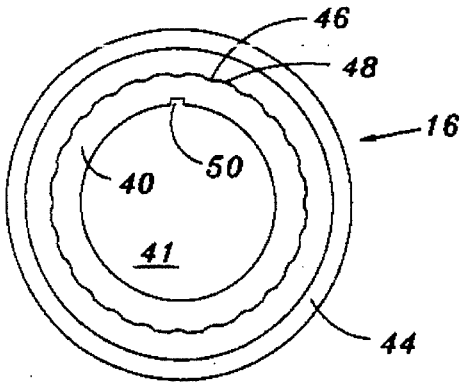
FIG. 5 is a bottom plan view of the inner cap shown in FIG. 4.
Figure 4:
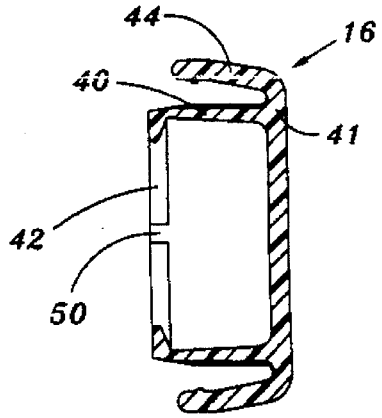
FIG. 4 is a sectional view of the inner cap component of the present invention.

FIG. 1 shows a container 11 with a bottle neck 10 onto which has been placed a cap 12 of the present invention. The cap 12 is comprised of two components, an outer cap 14 and an inner cap 16. The outer cap 14 has a skirt 18, and a central tube 20 joined to the skirt 18 by an annular base 22. The annular base 22 and the central tube 20 define a main passageway 24 through which fluid is intended to flow after the inner cap 16 is lifted from the central tube 20 by a probe 30 (See FIG. 6). A protective label 26 with a pull-tab 28 is placed on the outer surface of the annular base 22. The protective label 26 is placed on the outer surface of the annular base 22. The protective label 26 prevents dirt from coming into contact with the central tube 20 and the inside of the inner cap 16. The inner cap 16 is comprised of a guide sleeve 40 and a sealing sleeve 44 joined to the guide sleeve 40 by an inner cap base 41.

FIG. 2 is a bottom plan view of the cap of the present invention. The intermittent lugs 15 engage a circumferential recess formed in the upper portion of a water bottle neck to retain the cap firmly on a container. As can best be seen in FIG. 6, each lug 15 is comprised of a ramping surface 17 and a shorter arcuate surface 19 which abuts a bead 21 formed in the top of the bottle neck 10.

FIG. 6 is an enlarged sectional view showing the cap 12 of the present invention just prior to its placement over a blunt probe 30. The probe 30 includes an upper section 32 and a lower section 34 with a groove 36 therebetween. A conical portion 38 on the upper section 32 lies just above the groove 36. As the cap 12 is lowered into contact with the probe 30, the upper section 32 enters the passageway 24 and fits within a guide sleeve 40, which is part of the inner cap 16. A bead 42 at the free end of the guide sleeve 40 is spread by the conical section 38 and enters the groove 36 when the upper section 32 fully enters the guide sleeve 40. Upon further lowering of the cap 12, the sealing sleeve 44 of the outer cap 14 disengages from the central tube 20. As the inner cap 16 disengages from the central tube 20, the inside surface of the central tube 20 seals against the outside surface of the lower section 34 of the probe 30. Upon further lowering of the cap 12 over the probe 30, the uppermost edge 21 of the central tube 20 moves past and below the openings 31. At that point, the inside of the container 11 is in fluid communication with the hollow interior 33 o f the probe 30.

When substantially all of the contents of the container 11 have passed from the container 11 through the openings 31 and through the hollow interior 33, the container 11 can then be lifted from the probe 30. When the container 11 is lifted, the inner cap 16 is brought back into engagement with the central tube 20. The sealing sleeve 44 sealingly engages the outside surface of the central tube 20. To prevent the buildup of pressure in the space between the sealing sleeve 44 and the guide sleeve 40, the outside surface of the guide sleeve 40 is equipped with longitudinal channels 46 separated by splines 48. As an alternative to the channels 46 and the splines 48 on the guide sleeve 40, the upper part of the inside of the central tube 20 could be equipped with a channel or a series of channels to prevent the buildup of pressure in the space between the guide sleeve 40 and the sealing sleeve 44. Yet a further alternative would be to provide a single channel on the guide sleeve. Similarly, to prevent buildup of pressure on the inside of the guide sleeve 40 as the upper section 32 of the probe 30 becomes seated in the inner cap 16, a small break 50 is formed in the bead 42 on the free end of the guide sleeve 40. Alternatively, a series of breaks could be used to prevent the buildup of pressure within the inner cap 16.

To ensure that the inner cap 16 is securely engaged around the upper section 32 of the probe 30 before the sealing sleeve 44 begins to disengage from the outer surface of the central tube 20, the force required to push the bead 42 over the conical surface 38 into the groove 36 should be substantially less than the force required to disengage the bead 52 on the inside surface of the sealing sleeve 44 from the bead 54 on the outside surface of the central tube 20. FIG. 3 shows the positioning of the beads 52 and 54 in greater detail.

Achieving the proper relationship between the force required to attain engagement between the probe 30 and the inner cap 16, on the one hand, and the force required to disengage the outer cap 14 from the central tube 20, on the other hand, is important for proper performance of the cap of the present invention. The force required to engage the prove 30 with the inside of the inner cap 16 must be substantially less than the force required to life the inner cap 16 from the central tube 20. If this force relationship is not properly maintained, placement of the cap 12 over the probe 30 may result in the inner cap 16 failing to become engaged and held by the probe 30, thus becoming a "floater". A "floater" occurs when the inner cap 16 is pushed out of engagement with the central tube 20 before the bead 42 engages the groove 36 on the probe 30. If this were to occur, the inner cap 16 would come floating to the top of the liquid in the container. The presence of the guide sleeve 40 and the inwardly tapered surface on the free ends 43 (lower end in FIG. 3) reduces the tendency for the inner cap to become a "floater".

Also important to the proper performance of the cap of the present invention is the relationship between the force required to cause re-engagement of the sealing sleeve 44 with the central tube 20 and the force required to disengage the guide sleeve 40 from the upper section 32 of the probe 30. The force required to cause the bead 52 to move past the bead 54 as the cap 12 is lifted from the probe 30 must be substantially less than the force required to disengage the bead 42 from the groove 36. The absence of this relationship will result in the inner cap 16 being loose inside the container when the empty container is lifted off the probe 30. If the probe 30 is capable of disengaging from the inside of the guide sleeve 40 before the bead 52 moves past the bead 54, the inner cap 16 will be free to fall off of the central tube 20, and the passageway 24 will not be sealed on the container's return trip to the water bottling facility.

The gradual slope of the conical surface 56 adjacent to the bead 54, as shown in FIG. 3, makes it easy to obtain positive engagement of the beads 52 and 54. The inward (to the left in FIG. 3) resilience of the sealing sleeve 44 urges the central tube 20 inward. Pushing of the central tube 20 radially inward tends to increase the force required to cause the bead 42 to move out of the groove 34. The inwardly resilient action of the sealing sleeve 44 also contributes to the formation of a water-tight seal between the beads 52 and 54, and between the surface 56 on the central tube 20 and the inside surface 58 on the sealing sleeve 44. The inside surface 58 of the sealing sleeve 44 is shaped to fit snugly against the conical surface 56 when the sealing sleeve 44 is flexed outwardly to receive the upper part of the central tube 20. Thus, the cap 12 is designed so that a seal is formed between the inner cap 16 and the central tube 20 on the outside of the central tube 20. As used herein, reference to the outside of the central tube 20 is meant to include the upper surface of the free end of the central tube 20, which in the preferred embodiment is rounded to seal against a matching rounded surface at the inside of the inner cap base between the guide sleeve 40 and the sealing sleeve 44. It is possible than an effective seal between the inner cap 16 and the central tube 20 could be made by forming a seal only between the upper surface of the free end of the central tube 20 and the base of the inner cap 16 between the guide sleeve 40 and the sealing sleeve 44, only on a portion of the generally axially oriented part of the outside of the central tube 20. In such a situation, the seal between the inner cap 16 and the central tube 20 would be located only on the upper surface of the free end of the central tube 20, an that surface could include a sealing bid or other formation to enhance the seal forming ability of the surface.

The arrangement of the locking means and surfaces of the cap of the present invention enables the cap 12 to have well defined differentials between the connection and disconnection forces involved in replacing the inner cap 16 on the central tube 20 prior to and after engagement of the probe 30 with the inner cap 16.

FIGS. 7 and 8 show an alternative embodiment of the cap of the present invention. Numbers corresponding to the embodiment discussed with respect to FIG. 1 through 6 have been used to make reference to the alternative embodiment with the supplemental reference letter "a" added.

FIG. 7 is a plan view and FIG. 8 is a sectional view of the alternative cap 12*a*. Probe 30*a* also differs from the probe discussed earlier, primarily inn its internal characteristics. The probe 30*a* has a groove 36*a* and openings 31*a*. However, the probe 30*a* allows a small stream of air to enter the container through an air channel 33*a* when water flows out of the container through the central channel 35*a*. The cap 12*a* includes a pull-tab 60*a* which is used to remove the cap 12*a* from a bottle, preferably by a bottler after the bottle has made a return trip to the bottler's facility for refilling. The pull-tab 60*a* is adjacent to a scoreline 62*a*, which extends from the bottom edge of the skirt 18*a* through the circumferentially extending ramp 17*a*. A scoreline 64*a* then continues partially around the circumference of the cap 12*a* between the ramp 17*a* and a circumferential bead 19*a* which engages a recess on the upper portion of a bottle neck to hold the cap 12*a* in place. Except for the interruption causes by the scoreline 62*a*, the ramp 17*a* is continuous around the inside surface of the skirt 18*a*. A seal 66*a* is disposed in the cap 12*a* between the skirt 18*a* and the central tube 20*a*. The seal 66*a* is held in place by a small inwardly directed bead 68*a* which frictionally engages the outside edge of the seal 66*a*. It should be noted that an initially fluid compound which subsequently sets up and adheres to the inside of the cap could be used n lieu of the seal 66*a*, in which case the bead 68*a* may or may not be included.

The cap 12*a*, like the cap 12 shown in FIGS. 1 through 6, includes an inner cap 16*a* which engages a central tube 20*a*. The central tube 20*a*, and the components of the inner cap 16*a* are substantially identical to the central tube and inner cap of FIGS. 1 through 6, both in shape and in the way they perform.

In summary, proper performance of the cap of the present invention is dependent on two key relationships. The first is the relationship between the force required to achieve a positive connection at the probe/inner cap interface and the force required to disengage the inner cap 16 from the central tube 20. The second key relationship is the differential between the force required to achieve a positive connection at the inner cap/central tube interface and the force required to disengage the probe 30 from the inner cap 16. The cap of the present invention 12 allows for proper design of these relationships by physically separating the location of the components which determine these forces and the resulting differentials. Specifically, the means by which the inner cap 16 is held in lace on the central tube 20 is physically separated from the means by which the inner cap 16 is retained by the probe 30. Also significant is the fact that the seals required for proper functioning of the cap of the present invention are also physically separated. The seal between the lower section 34 of the probe 30 is on the inside surface of the central tube 20. In contrast, the seal between the inner cap 16 and the outer cap 14 is located on the outside surface of the central tube 20. Thus, these seals are more effective because they involve separate and distinct physical components which are not directly interrelated.

While a specific embodiment of the invention has been shown and described, it will be apparent to those skilled in the art that numerous alternatives, modifications, and variations of the embodiment shown can be made without departing from the spirit and scope of the appended claims.

We claim:

1. A cap for use in a dispensing system, said cap comprising a main outer cap and an inner cap, said main outer cap having a skirt and a central tube, said tube being shaped to sealing engage a probe of said dispensing system, said inner cap being engageable with said probe so as to move into and out of sealing engagement with said tube, said skirt and said central tube being connected by an annular base, said tube having one end attached to said base and a free end opposite said one end, said free end having an outer surface, said inner cap having an inner sleeve and an outer sleeve, said outer sleeve being shaped to form a seal on an outer surface of said tube, said sleeves being joined at one end by an inner cap base, said sleeves defining a cylindrical recess, said free end of said tube shaped to fit snugly into said recess and form a seal preventing fluid from flowing through said tube.

2. A cap in accordance with claim 1 wherein:

said inner sleeve is longer than said outer sleeve, said inner sleeve having channels along an outer surface of said inner sleeve to prevent build-up of pressure within said recess during placement of said inner cap on said free end.

3. A cap accordance with claim 2 wherein:

said channels are formed between splines extending from said inner cap base to a free end of said guide sleeve.

4. A cap in accordance with claim 1 wherein:

said free end of said central tube has a tapered outer surface to facilitate engagement of said outer sleeve of inner cap with said free end.

5. A cap in accordance with claim 4 wherein:

said outside sleeve has a first bead on an inside surface thereof, and said central tube has a second bead adjacent to said tapered surface, said first and second beads being engageable to retain said inner cap on said central tube when said free end of said central tube is in said recess.

* * * * *